US006631903B2

(12) United States Patent
Takeda

(10) Patent No.: US 6,631,903 B2
(45) Date of Patent: Oct. 14, 2003

(54) PAPER DISCHARGE APPARATUS AND PRINTER

(75) Inventor: Yoshinori Takeda, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 99 days.

(21) Appl. No.: 09/930,995

(22) Filed: Aug. 17, 2001

(65) Prior Publication Data

US 2002/0020962 A1 Feb. 21, 2002

(30) Foreign Application Priority Data

Aug. 18, 2000 (JP) ..... P.2000-248824

(51) Int. Cl.[7] ..... B65H 39/10; B41J 11/26

(52) U.S. Cl. ..... 271/301; 400/621

(58) Field of Search ..... 271/301, 304, 271/184, 186, 314, 902; 399/364; 270/20.1; 400/612, 621, 642; 358/304; 396/613, 445; 53/389.3; B41J 11/66

(56) References Cited

U.S. PATENT DOCUMENTS 4,359,217 A * 11/1982 Roller et al. ..... 271/186
5,449,164 A * 9/1995 Quesnel et al. ..... 271/186
5,649,776 A * 7/1997 Sugimoto et al. ..... 400/617
5,720,478 A * 2/1998 Carter et al. ..... 271/186
6,056,460 A * 5/2000 Suzuki ..... 400/621

FOREIGN PATENT DOCUMENTS

| | | |
|---|---|---|
| EP | 0 725 028 A1 | 8/1996 |
| EP | 0 811 572 A1 | 12/1997 |
| EP | 1 004 452 A1 | 5/2000 |
| JP | 9-25029 | 1/1997 |

* cited by examiner

*Primary Examiner*—Donald P. Walsh
*Assistant Examiner*—Kenneth W Bower
(74) *Attorney, Agent, or Firm*—Sughrue Mion, PLLC

(57) ABSTRACT

A paper discharge apparatus includes: a paper guide (6) for guiding paper (5) provided from a paper conveyance mechanism (1); a paper guide (7) disposed on a downstream side of the paper guide (6) for deflecting the paper (5) downward; a pair of rollers (9) and (10) between which the paper (5) can be conveyed forward or backward while the paper (5) is held by the rollers (9, 10); a pair of upper and lower paper guides (21, 22) disposed on the downstream side of the pair of rollers (9,10); and a paper guide (8) by which the paper conveyed backward by the pair of rollers (9, 10) is guided downward.

10 Claims, 2 Drawing Sheets

PAPER DISCHARGE APPARATUS AND PRINTER

BACKGROUND OF THE INVENTION

1. Field of the Invention

The present invention relates to a paper discharge apparatus for issuing a piece of paper such as a receipt, a ticket, or the like, and a printer using the paper discharge apparatus.

2. Description of the Related Art

An apparatus for issuing a receipt, a ticket, or the like, is generally formed as follows. A long sheet of paper shaped like a roll is housed in the apparatus in advance. Printing is performed on the long sheet of paper in accordance with a print command given from an external host computer. Then, the long sheet of paper is cut into a predetermined length, so that the cut piece of paper is discharged from a vending port.

If a recipient pulls forcibly the piece of paper discharged from the vending port or blocks the vending port to disturb discharge of the piece of paper in the aforementioned issuing apparatus, the recipient's behavior causes a print failure or paper jam. Therefore, a paper discharge apparatus has been employed in which a sheet of paper is temporarily kept in the inside of the apparatus before printing and cutting of the sheet of paper is completed, and then a leading edge of the sheet of paper is made exposed out of the vending port after the cutting is completed.

A paper discharge apparatus has been also employed in which a function of collecting a piece of paper into the inside of the apparatus after the passage of a predetermined time is added because leaving the piece of paper alone causes an obstacle to the next issuing operation when the piece of paper discharged from the vending port is forgotten.

Examples of the related background art have been disclosed in, for example, JP-A-1-181659, JP-A-5-43127, JP-A-8-169149, and JP-A-8-268638.

Paper provided from a paper roll generally has the tendency to curl. The curling condition such as the curling direction or the curling amount is varied according to various factors.

When the discharged paper is to be collected, a leading or trailing edge of the paper is apt to get entangled midway in accordance with the curling condition of the paper. For secure collection of the paper without dependence on the curling condition, it is therefore necessary to provide a conveyance mechanism and a paper path changing mechanism exclusively used for collection, a driving source such as solenoid exclusively used for collection, and so on. As a result, the apparatus increases in size or is complicated.

SUMMARY OF THE INVENTION

The present invention has been made under the above circumstances, and therefore an object of the present invention is to provide a paper discharge apparatus in which an operation of changing the direction of discharge of paper can be achieved in a simple structure, and a printer using the paper discharge apparatus.

In order to solve the above object, according to the present invention, there is provided a paper discharge apparatus comprising: a first guide portion by which a sheet of paper to be conveyed is guided along a first conveyance path; a second guide portion by which the sheet of paper guided by the first guide portion is guided along a second conveyance path inclined with respect to the first conveyance path; a reversible conveyance portion by which the sheet of paper guided by the second guide portion can be conveyed either forward or backward; and a third guide portion by which the sheet of paper conveyed backward by the reversible conveyance portion is guided along a third conveyance path different from the first and second conveyance paths.

According to the present invention, the sheet of paper guided by the first guide portion is guided by the second guide portion so as to be deflected from the first conveyance path. As a result, the sheet of paper reaches the reversible conveyance portion. In the reversible conveyance portion, the direction of discharge of the sheet of paper can be changed by a selective operation in accordance with forward conveyance or backward conveyance. When the reversible conveyance portion conveys the sheet of paper backward, the sheet of paper is guided along the third conveyance path different from the first and second conveyance paths by the third guide portion.

When, for example, a discharge port is disposed on an extension of the direction of forward conveyance in the reversible conveyance portion and a paper collection portion is disposed on an extension of the direction of backward conveyance in the reversible conveyance portion, forward conveyance permits a piece of paper to be issued and backward conveyance permits a piece of paper to be collected. Incidentally, configuration may be made so that the paper collection portion is disposed on an extension of the forward conveyance direction and the discharge port is disposed on an extension of the backward conveyance direction.

Alternatively, configuration may be made so that two discharge ports are disposed on extensions of the forward and backward conveyance directions respectively. Alternatively, configuration may be made so that two paper collection portions are disposed on extensions of the forward and backward conveyance directions, respectively.

As described above, the reversible conveyance portion is disposed in a position displaced from the first conveyance path. Further, the second guide portion is provided so that the paper conveyed along the first conveyance path is guided to the reversible conveyance portion by the second guide portion. Further, the third guide portion is provided so that the piece of paper conveyed backward by the reversible conveyance portion is guided along the third conveyance path by the third guide portion. Hence, the operation of changing the direction of discharge of paper can be carried out while the piece of paper is prevented from being conveyed backward to the first conveyance path. Hence, the conveyance mechanism and the paper path changing mechanism exclusively used for collection, the driving source such as solenoid exclusively used for collection, and so on, which have been required in the background art, become needless. Hence, reduction in size of the apparatus and simplification in configuration of the apparatus can be attained.

Further, according to the present invention, the reversible conveyance portion includes a first roller and a second roller between which the sheet of paper conveyed is held; and the first and second rollers are disposed so that a common line tangential to both the rollers crosses a paper guide surface of the third guide portion.

According to the present invention, the common line tangential to the first and second rollers, between which the piece of paper is held while conveyed, crosses the paper-guide surface of the third guide portion. Accordingly, when the piece of paper is conveyed backward, the piece of paper can be prevented securely from being conveyed backward to the first conveyance path because the trailing edge of the piece of paper abuts on the paper-guide surface of the third guide portion so as to be guided by the third guide portion.

Further, according to the present invention, the third guide portion is formed so as to be integrated with the first guide portion.

According to the present invention, the third guide portion is formed so as to be integrated with the first guide portion. Accordingly, reduction in the number of constituent parts can be attained. Because a front end portion of the third guide portion can be disposed to be near the first guide portion, the piece of paper can be led to the third conveyance path smoothly even in the case where the leading edge of paper has the tendency to curl.

Further, according to the present invention, the second guide portion includes a paper detection portion for detecting the passage of the sheet of paper.

According to the present invention, because the second guide portion is provided with the paper detection portion, the start point of time of the passage of paper and the end point of time of the passage of paper can be detected in the condition that the leading edge of the piece of paper and the trailing edge of the piece of paper approach the reversible conveyance portion as much as possible. Hence, the timing of controlling the operation of the reversible conveyance portion can be set accurately.

Further, the paper discharge apparatus according to the present invention further comprises: a loop housing portion in which slack of the sheet of paper to be conveyed is housed when the reversible conveyance portion stops conveying; a paper discharge portion by which the sheet of paper is discharged to the outside when the reversible conveyance portion conveys the sheet of paper forward; and a paper collection portion by which the sheet of paper is collected when the reversible conveyance portion conveys the sheet of paper backward.

According to the present invention, because the loop housing portion is provided for housing slack of the sheet of paper when conveyance stops, paper with a sufficient length can be temporarily kept before discharge. When, for example, paper having the tendency to be curled upward convexly is used, the loop housing portion is preferably disposed above the first conveyance path so that upward slack of the paper can be housed in the loop housing portion. Hence, stress imposed on the paper can be lightened, so that the paper can be prevented from being wrinkled, broken, bent, and so on.

Further, when the reversible conveyance portion conveys the paper forward, a piece of paper can be issued through the paper discharge port. When the reversible conveyance portion conveys the paper backward, the paper can be collected in the paper collection portion. The operation of changing over between issue and collection of the paper can be achieved in the aforementioned simple configuration.

Further, according to the present invention, there is provided a printer comprising: a paper conveyance portion for conveying a long sheet of paper; a print portion for performing printing on the sheet of paper; a cutter portion for cutting a printed piece of paper from the sheet of paper; and the paper discharge apparatus for issuing or collecting the cut piece of paper.

According to the present invention, a printer having a function of issuing a piece of paper while changing the print contents as required, and a function of collecting the piece of paper issued can be achieved in small-size and simple configuration.

BRIEF DESCRIPTION OF THE DRAWINGS

FIGS. 1A and 1B are configuration views showing an embodiment of the present invention, in which FIG. 1A is a view showing the state in which a loop is formed, and FIG. 1B is a view showing the state in which paper is collected;

DETAILED DESCRIPTION OF THE PREFERRED EMBODIMENTS

Now, a description will be given in more detail of preferred embodiments of the invention with reference to the accompanying drawings.

Figure 1B:
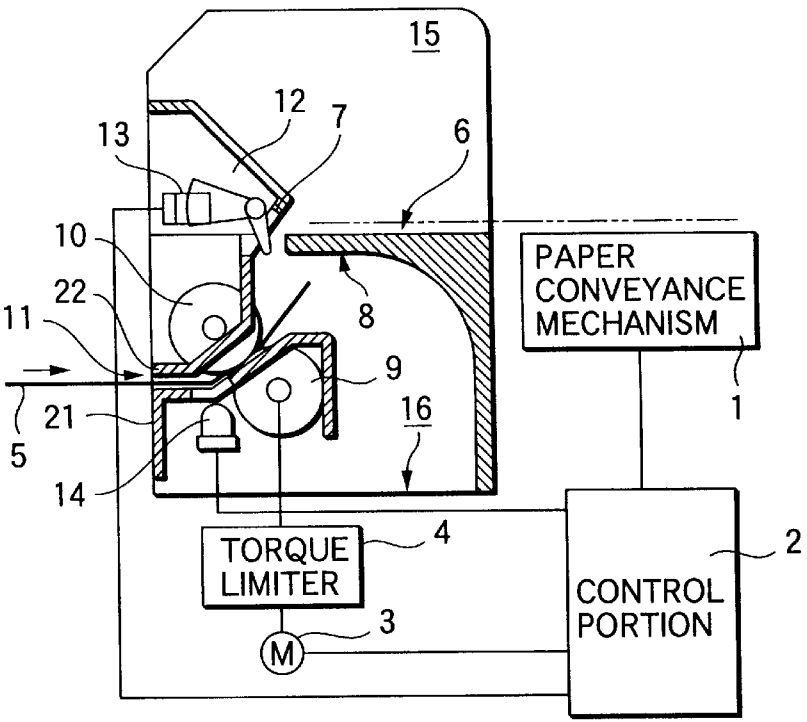
Figure 1A:
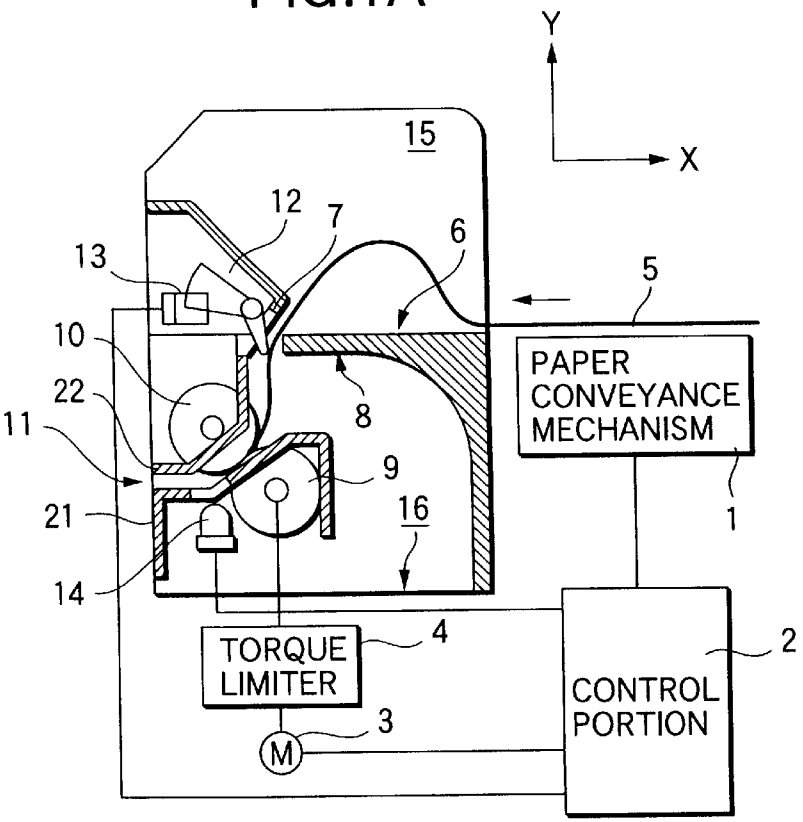

FIGS. 1A and 1B are configuration views showing an embodiment of the present invention. FIG. 1A is a view showing the state in which a loop is formed. FIG. 1B is a view showing the state in which paper is collected. The paper discharge apparatus comprises: a paper guide 6 for guiding paper 5 provided from a paper conveyance mechanism 1; a paper guide 7 disposed on the downstream side of the paper guide 6 for deflecting the paper 5 downward; a pair of rollers 9 and 10 between which the paper 5 is held so as to be conveyed forward or backward; a pair of upper and lower paper guides 21 and 22 disposed on the downstream side of the pair of rollers 9 and 10; and a paper guide 8 by which the paper conveyed backward by the pair of rollers 9 and 10 is guided downward.

For example, the paper conveyance mechanism 1 is constituted by a printer having a paper roll housing portion, a paper conveyance portion, a print portion, a cutter portion, etc. Hence, the paper conveyance mechanism 1 has a function to perform printing on the paper 5 desirably and cut the paper into a predetermined length.

The paper guide 6 has a horizontal paper-guide surface, so that the paper guide 6 supports up the paper 5 conveyed along a first conveyance path by the paper conveyance mechanism 1.

The paper guide 7 has a paper-guide surface inclined downward with respect to the first conveyance path, and a vertical paper-guide surface. The paper guide 7 is disposed with separation of a predetermined gap from the downstream end of the paper guide 6. The paper guide 7 guides the paper 5 along a second conveyance path which extends from the end of the first conveyance path to the pair of rollers 9 and 10. A trailing edge detection portion is provided in the inclined guide surface of the paper guide 7 so that the trailing edge of the paper 5 can be detected. The trailing edge detection portion is composed of a sensor lever 12 protruded from the inclined guide surface and supported angularly displaceably, and a paper trailing edge detection sensor 13 such as a photo-coupler. The operation of the trailing edge detection portion is as follows. When the paper 5 is conveyed forward, the leading edge of the paper 5 pushes down the sensor lever 12 to angularly displace the sensor lever 12 clockwise. When a rear arm of the sensor lever 12 opens a light-receiving portion of the paper trailing edge detection sensor 13, it is determined that the leading edge has passed. Then, the trailing edge of the paper 5 passes through the sensor lever 12, so that the sensor lever 12 is restored to its original state. When the rear arm shuts the light-receiving portion of the paper trailing edge detection sensor 13, it is determined that the trailing edge of the paper has passed.

The pair of rollers 9 and 10 form a reversible conveyance portion by which the paper 5 guided by the paper guide 7 can be conveyed forward or backward. The roller 9 is disposed on the right-handed lower side of the paper path whereas the roller 10 is disposed on the left-handed upper side of the paper path. The common line tangential to the pair of rollers 9 and 10 is inclined obliquely. For example, the common tangential line is set so as to make an angle of about 45 degrees with respect to a horizontal X axis.

The pair of paper guides 21 and 22 guide the paper 5, which is conveyed forward by the pair of rollers 9 and 10, to a paper discharge port 11 formed on the downstream side. A paper leading edge detection sensor 14 such as a photosensor is provided in the lower surface of the lower paper guide 21. The sensor 14 makes detection through an opening of the paper guide 21 as to whether paper is present or absent. When the absence of paper is changed over to the presence of paper, it is determined that the leading edge of the paper has passed. Although here is shown the case where the upper paper guide 22 is formed so as to be integrated with the paper guide 7, it is a matter of course that the upper paper guide 22 and the paper guide 7 may be provided separately.

The paper guide 8 has a paper-guide surface shaped like a circular arc facing inward the pair of rollers 9 and 10. The paper 5 conveyed backward by the pair of rollers 9 and 10 is guided downward along a third conveyance path different from the first and second conveyance paths by the paper guide 8. The common line tangential to the pair of rollers 9 and 10 crosses the paper-guide surface of the paper guide 8 at an acute angle. Hence, the trailing edge of the paper 5 conveyed backward is guided along the paper-guide surface of the guide portion 8 smoothly.

The paper guide 8 and the paper guide 6 may be provided separately. However, if the paper guide 8 is formed so as to be integrated with the paper guide 6, reduction in the number of constituent parts can be attained. In addition, the paper can be led to the third conveyance path smoothly even in the case where the paper has the tendency to curl. This is because the front end portion of the paper guide 8 can be disposed to be near the paper guide 6.

A loop housing portion 15 is provided above the paper guide 6 so that slack of the paper 5 caused by the stop of the rotation of the rollers 9 and 10 is housed in the loop housing portion 15. A paper collection portion 16 is provided below the paper guide 8 so that the paper 5 conveyed backward is collected in the paper collection portion 16.

Detection signals of the sensors 13 and 14 are inputted to the control portion 2 which controls the operation of the paper conveyance mechanism 1. Upon reception of the signals, the control portion 2 controls the operation of the DC motor 3 for driving the pair of rollers 9 and 10 to rotate. A torque limiter 4 is interposed between the DC motor 3 and the pair of rollers 9 and 10. The torque limiter 4 cuts off torque transmission when a recipient pulls out the discharged paper forcibly or blocks the discharge port so that a load of not smaller than a predetermined value is imposed on the pair of rollers 9 and 10.

The operation of the apparatus will be described below. When the paper conveyance mechanism 1 starts conveyance of paper 5, the leading edge of the paper 5 is guided along the first conveyance path of the paper guide 6. When the leading edge of the paper 5 abuts on the inclined guide surface of the paper guide 7, the paper 5 is deflected downward and enters the second conveyance path. When the paper 5 passes through the sensor lever 12 so that the paper trailing edge detection sensor 13 is switched on, the control portion 2 drives the DC motor 3 to rotate forward. The leading edge of the paper 5 reaches the pair of rollers 9 and 10 and is further conveyed forward while held between the pair of rollers 9 and 10.

When the leading edge of the paper 5 conveyed forward by the pair of rollers 9 and 10 enters the pair of paper guides 21 and 22 so that the paper leading edge detection sensor 14 is switched on, the control portion 2 stops the rotation of the DC motor 3. As a result, the pair of rollers 9 and 10 also stop, so that the paper 5 is clamped between the pair of rollers 9 and 10. When the paper conveyance mechanism 1 continues conveyance, the paper 5 is slacked upward in accordance with its tendency to curl. As shown in FIG. 1A, the slacked paper 5 shaped like a loop is stored in the loop housing portion 15.

When the paper conveyance mechanism 1 stops conveyance and cuts the paper 5, the control portion 2 restarts forward rotation of the DC motor 3 so that the paper 5 is conveyed forward until the paper trailing edge detection sensor 13 is switched off. When the trailing edge of the paper passes through the sensor lever 12 so that the sensor 13 is switched off, the control portion 2 stops the rotation of the DC motor 3. As a result, the trailing edge of the paper 5 held between the pair of rollers 9 and 10 is displaced from the paper guide 6. As shown in FIG. 1B, when the paper 5 is strong in stiffness, the paper 5 is supported by the rollers 9 and 10 along the common line tangential to the pair of rollers 9 and 10. When the paper 5 is weak in stiffness or has the tendency to convex curl, the trailing edge of the paper 5 hangs down with respect to the common line tangential to the pair of rollers 9 and 10. On this occasion, the leading edge of the paper 5 is exposed on the paper discharge port 11. The apparatus is stopped for a predetermined time in this condition to wait for the recipient to pull out the paper 5. The torque limiter 4 prevents unreasonable load from being transmitted to the torque transmission mechanism when the recipient pulls out the paper 5.

If the paper leading edge detection sensor 14 is not switched off after an elapse of a predetermined time in the condition that the leading edge of the paper 5 is exposed, it is determined that the recipient forgot the paper, and the operation of collecting the paper 5 is started.

When the control portion 2 drives the DC motor 3 to rotate backward, the pair of rollers 9 and 10 convey the paper 5 backward. As a result, the trailing edge of the paper 5 comes into contact with the paper-guide surface of the paper guide 8 and is guided downward along the third conveyance path. When backward conveyance is continued by the time required for the leading edge of the paper 5 to pass through the pair of rollers 9 and 10 after the paper leading edge detection sensor 14 is switched off, the paper 5 is dropped down to the paper collection portion 16 by its own weight and then the control portion 2 stops the rotation of the DC motor 3.

As described above, the pair of rollers 9 and 10 are disposed in positions displaced from the first conveyance path. Further, the paper guide 7 is provided so that the paper conveyed along the first conveyance path is guided to the pair of rollers 9 and 10 by the paper guide 7. Further, the paper guide 8 is provided so that the paper conveyed backward by the pair of rollers 9 and 10 is guided along the third conveyance path by the paper guide 8. Hence, the operation of changing the direction of discharge of the paper can be carried out while the paper is prevented from being conveyed backward to the first conveyance path.

Figure 2:
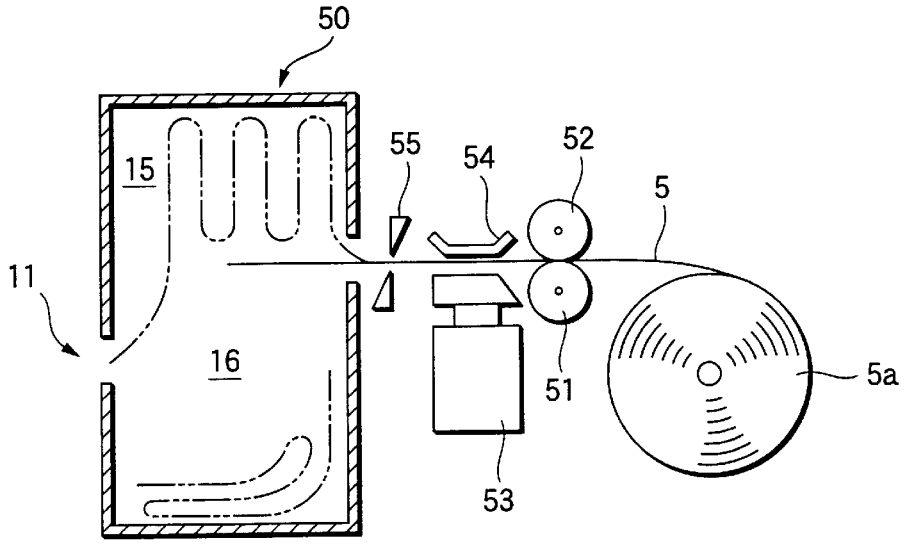
FIG. 2 is a configuration view showing an example of a printer according to the present invention.

FIG. 2 is a configuration view showing an example of a printer according to the present invention. The printer comprises: a paper roll 5*a* constituted by a long sheet of paper 5 rolled; a pair of rollers 51 and 52 for feeding paper 5 from the paper roll 5*a* and conveying the paper 5; a print head 53 for performing printing on the conveyed paper 5; a platen 54 opposite to the print head 53; a cutter 55 for cutting the printed paper 5; and a paper discharge apparatus 50 shown in FIG. 1. The paper discharge apparatus 50 has a discharge function by which the paper 5 under printing is stored temporarily. The piece of paper cut by the cutter 55 is issued from the paper discharge port 11 or collected in the paper collection portion 16 by the paper discharge apparatus 50.

When the paper 5 is provided from the upper side of the paper roll 5*a*, the paper 5 to be conveyed and printed has the tendency to be curled upward convexly. Because the paper 5 is apt to be slacked upward from the first conveyance path when the paper discharge apparatus 50 executes the discharge buffer function, the loop housing portion 15 is preferably disposed above the first conveyance path. In addition, because the system in which the paper is dropped down by its own weight is simple in configuration for paper collection, the paper collection portion 16 is preferably disposed below the first conveyance path.

Figure 3:
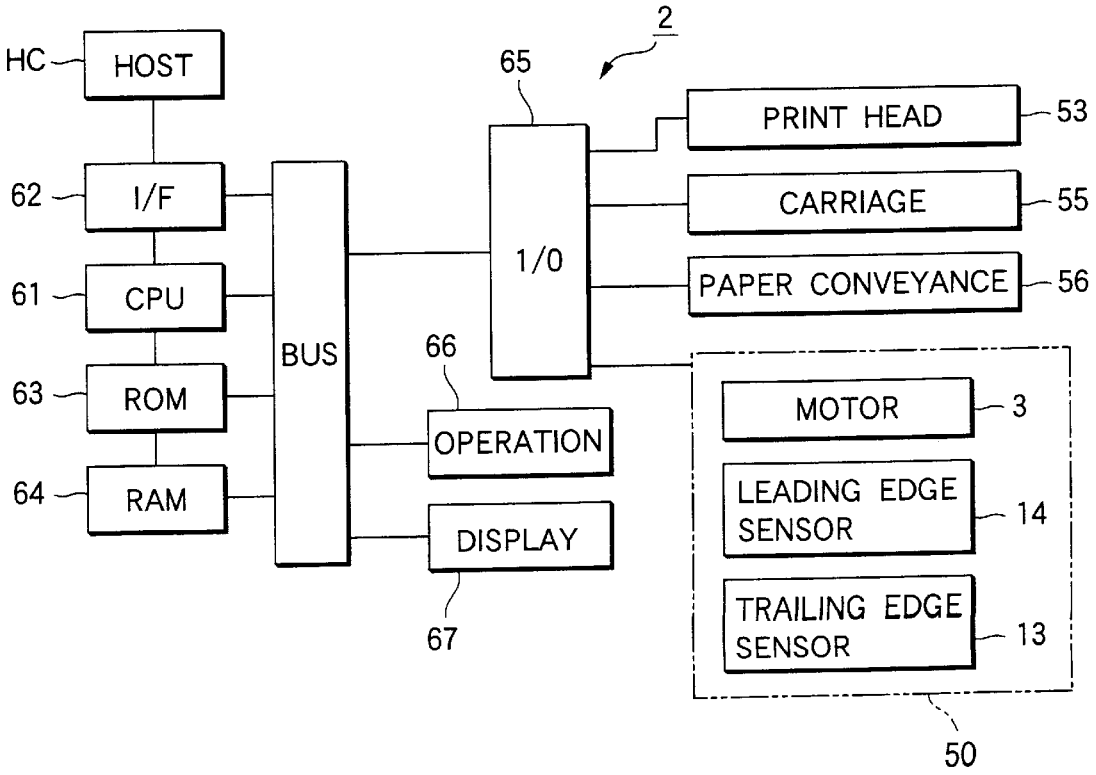
FIG. 3 is a block diagram showing the electrical configuration of the printer according to the present invention.

FIG. 3 is a block diagram showing the electrical configuration of the printer according to the present invention. A control portion 2 of the printer comprises: a central processing unit (CPU) 61 for controlling the overall operation of the printer in accordance with a predetermined program; an interface (I/F) 62 for transmitting/receiving data between the printer and an external host computer HC; a read-only memory (ROM) 63 and a random-access memory (RAM) 64 for storing programs and data; an input/output (I/O) circuit 65 for transmitting/receiving data between the printer and a peripheral circuit such as a mechanism portion or a sensor; an operation portion 66 such as an operation switch; and a display portion 67 such as a light-emitting diode (LED) or a liquid-crystal display panel (LCD).

A print head 53, a carriage portion 55 for reciprocating the print head 53, a paper conveyance portion 56 for conveying the paper 5, a paper discharge apparatus 50 having a DC motor 3, a paper leading edge detection sensor 14 and a paper trailing edge detection sensor 13, and so on, are connected to the I/O circuit 65.

The paper discharge apparatus 50 is formed so as to be mechanically and electrically detachable with respect to the printer body. The operation of the paper discharge apparatus 50 is overall controlled by the CPU 61 of the printer body.

Incidentally, the paper discharge apparatus 50 may have a CPU exclusively used for itself so that the operation of the paper discharge apparatus 50 can be associated with the operation of the printer through communication between the paper discharge apparatus 50 and the printer body.

As described above, in accordance with the present invention, the reversible conveyance portion is disposed in a position displaced from the first conveyance path. Further, the second guide portion is provided so that the paper conveyed along the first conveyance path is guided to the reversible conveyance portion by the second guide portion. Further, the third guide portion is provided so that the paper conveyed backward by the reversible conveyance portion is guided along the third conveyance path by the third guide portion. Hence, the operation of changing the direction of discharge of the paper can be carried out while the paper is prevented from being conveyed backward to the first conveyance path. As a result, the conveyance mechanism and the paper path changing mechanism exclusively used for collection, the driving source such as solenoid exclusively used for collection, and so on, which have been required in the background art, become needless. Hence, reduction in size of the apparatus and simplification in configuration of the apparatus can be attained.

What is claimed is:

1. A paper discharge apparatus comprising:

a first guide portion by which a sheet of paper to be conveyed is guided along a first conveyance path;

a second guide portion by which said sheet of paper guided by said first guide portion is guided along a second conveyance path inclined with respect to said first conveyance path;

a reversible conveyance portion by which said sheet of paper guided by said second guide portion can be conveyed either forward or backward;

a third guide portion by which said sheet of paper conveyed backward by said reversible conveyance portion is guided along a third conveyance path different from said first and second conveyance paths; and a loop housing portion that is disposed at an opposite side of said third guide portion with said first guide portion interposed there between and houses a slack of paper when said reversible conveyance portion stops conveyance.

2. A paper discharge apparatus according to claim 1, wherein said reversible conveyance portion includes a first roller and a second roller between which said sheet of paper conveyed is held; and wherein said first and second rollers are disposed so that a common line tangential to both said rollers crosses a paper guide surface of said third guide portion.

3. A paper discharge apparatus according to claim 1, wherein said third guide portion is integrated with said first guide portion.

4. A paper discharge apparatus according to claim 1, wherein said second guide portion includes a paper detection portion for detecting the passage of said sheet of paper.

5. A paper discharge apparatus according to claim 1, further comprising:

a paper discharge portion which discharges said sheet of paper to the outside when said reversible conveyance portion conveys said sheet of paper forward; and a paper collection portion which collects said sheet of paper when said reversible conveyance portion conveys said sheet of paper backward.

6. A printer comprising:

a paper conveyance portion for conveying a long sheet of paper;

a print portion for performing printing on said sheet of paper;

a cutter portion for cutting printed piece of paper from said sheet of paper; and a paper discharge apparatus according to any one of claims 1 to 5, for issuing or collecting said cut piece of paper.

7. A paper discharge apparatus, comprising:

a first guide portion which guides a sheet of paper that is being conveyed along a first conveyance path;

a second guide portion which guides the sheet of paper guided by said first guide portion forward or backward along a second conveyance path inclined with respect to the first conveyance path;

a reversible conveyance portion which can convey the sheet of paper guided by said second guide portion forward or backward;

a third guide portion which guides the sheet of paper conveyed backward by said reversible conveyance portion along a third conveyance path different from the first and second conveyance paths; and a loop housing portion that houses the slack of the sheet of paper when said reversible conveyance portion stops to convey the sheet of paper, wherein said third guide portion is disposed below said first guide portion and said loop housing portion is disposed above said first guide portion.

8. A paper discharge apparatus according to claim 7, wherein said third guide portion is integrated with said first guide portion.

9. A paper discharge apparatus according to claim 7, wherein said second guide portion includes a paper detection portion which detects the passage of the sheet of paper.

10. A paper discharge apparatus according to claim 7, further comprising:

a paper discharge portion which discharges said sheet of paper to the outside when said reversible conveyance portion conveys said sheet of paper forward; and a paper collection portion which collects said sheet of paper when said reversible conveyance portion conveys said sheet of paper backward.

* * * * *